United States Patent [19]

Rudolf et al.

[11] Patent Number: 5,003,885

[45] Date of Patent: Apr. 2, 1991

[54] WARHEAD FOR AN AIRBORNE BODY

[75] Inventors: Karl Rudolf, Schrobenhausen; Konrad Ringel, Leinburg, both of Fed. Rep. of Germany

[73] Assignee: Diehl GmbH & Co., Nuremberg, Fed. Rep. of Germany

[21] Appl. No.: 451,116

[22] Filed: Dec. 14, 1989

[30] Foreign Application Priority Data

Dec. 23, 1988 [DE] Fed. Rep. of Germany ..... 3843432

[51] Int. Cl.[5] ..... F42B 12/32

[52] U.S. Cl. ..... 102/494; 102/475

[58] Field of Search ..... 102/491–497, 102/475, 476

[56] References Cited

U.S. PATENT DOCUMENTS

| | | | |
|---|---|---|---|
| 3,731,633 | 5/1973 | Davis | 102/475 |
| 3,974,771 | 8/1976 | Thomanek . | |
| 4,374,495 | 2/1983 | Thomanek | 102/476 |

*Primary Examiner*—Harold J. Tudor

*Attorney, Agent, or Firm*—Scully, Scott, Murphy & Presser

[57] ABSTRACT

A warhead for an airborne body which is employed for the attacking of a lightly-armored target through the intermediary of splinters or fragments, and wherein the warhead possesses within a protective enclosure a safe-and-arm and triggering arrangement, an explosive charge and a splinter-forming insert.

8 Claims, 1 Drawing Sheet

WARHEAD FOR AN AIRBORNE BODY

BACKGROUND OF THE INVENTION

1. Field of the Invention

The present invention relates to a warhead for an airborne body which is employed for the attacking of a lightly-armored target through the intermediary of splinters or fragments, and wherein the warhead possesses within a protective enclosure a safe-and-arm and triggering arrangement, an explosive charge and a splinter-forming insert.

2. Discussion of the Prior Art

From the disclosure of U.S. Pat. No. 3,974,771 there has become known a warhead for an airborne body, in which a rotationally-symmetrical insert consisting of globe-shaped splinters is provided in the format of a cone narrowing in the direction of flight. The triggering location for the explosive charge is located centrally within the main axis and; namely, in the region of the rear wall of the warhead.

Upon the detonating of the explosive charge, there is generated a rotationally-symmetrical fragment or splinter cone which is somewhat at an incline or angled relative to the direction of flight. Consequently, when used for deployment against ground targets, only a small portion of the splinters are actually effective.

SUMMARY OF THE INVENTION

In accordance with the foregoing, it is an object of the present invention to propose a warhead of this type, through which there is attained a high fragment or splinter density with regard to a ground target which is to be attacked.

The foregoing object is achieved with a warhead for an airborne body of the type described herein, in that the splinter-producing insert is formed somewhat cushion-shaped and located in generally a single main plane, whereby this main plane intersects the longitudinal axis of the warhead at an angle within the range of about 5° to 30°. The cushion-shaped insert, when viewed in the direction of flight, has its bottom located below a transverse axis 17 of the warhead in the region of a rear wall of the warhead and rises continually in the direction of flight, and in which the triggering location for the explosive charge is generally located within a longitudinal symmetrical axis of the charge but in proximity to the rear wall of the warhead.

It is important to the invention that, notwithstanding a relatively small number of splinters or fragments, there is achieved a high splinter density with respect to a ground target. This is because all splinters which are present are directed against the ground target.

Pursuant to a further feature of the invention, in which the triggering location is at a distance from the rear wall of the warhead, which is about 1/5 the length of the charge, there is achieved an increased splinter range in the direction of flight in that the triggering location is located generally in the lower third of the length of the charge.

Through a further feature of the invention, there is obtained an optimized splinter spread or cone; and in essence, with the following limitations: In the region of the rear wall of the warhead the splinter spread is limited to a right angle, and in the direction of the longitudinal axis of the airborne body, the forwardly oriented limitation of the splinter spread lies within an angle of 30° relative to the axis of the airborne body.

Accordingly to further features of the invention, the splinters which are located generally in the center of the insert, whereby the insert is slightly convexly curved in a transverse direction relative to its main plane, or is slightly convexly curved in the longitudinal direction of its main plane, are imparted a relatively high kinetic energy through the column of the explosive which is higher in comparison with the edge regions.

A trapezoidally-shaped splinter-producing insert forming a maximum possible number of splinters is achieved through a further feature of the invention in that a housing for the explosive charge bounds the sides of the insert through end surfaces provided in an opening in the protective enclosure.

A large splinter density is present at the beginning of the splinter spread towards the base, in that a section of the insert in the region of its base is located in parallel with the transverse axis and the longitudinal axis of the warhead, whereby the beginning zone of the splinter spread is relatively closely restricted and is reproducible.

Pursuant to a further feature, in which the angle between the longitudinal axis and the insert is about 10°, the angle of the insert is optimized with respect to the splinter spread at the base.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
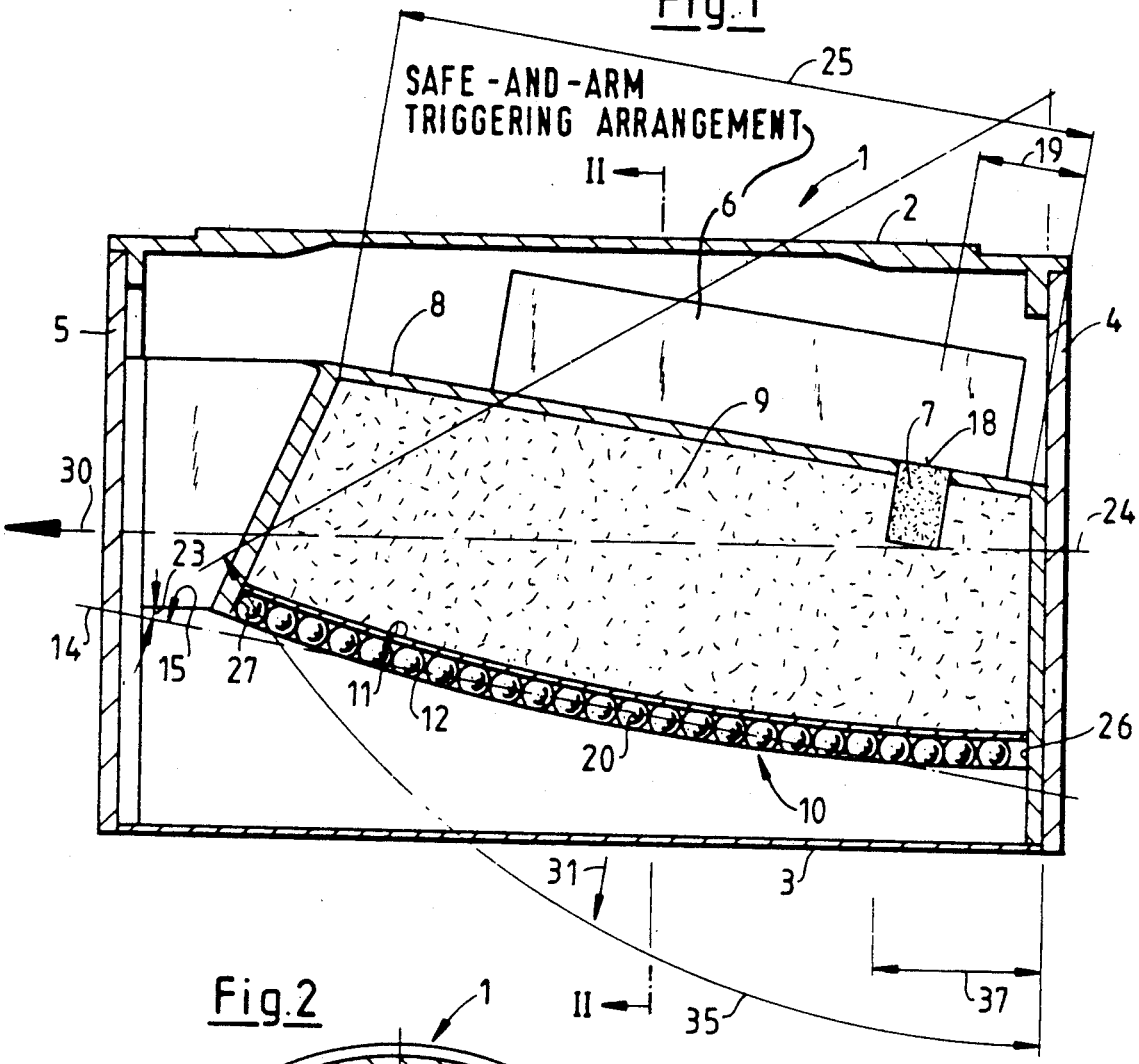
FIG. 1 illustrates a longitudinal sectional view through a warhead.

A warhead 1 of an airborne body (not shown) consists of a two-part protective enclosure 2, 3, a rear wall 4, a front wall 5, a safe-and-arm and triggering arrangement 6 with a booster charge 7 at a distance 19 from the rear wall 4, a housing 8 for an explosive charge, an explosive charge 9, and a fragment or splinter-producing insert 10 with two cover plates 11, 12.

This insert 10 is generally cushion-shaped, in essence, slightly convexly curved along the axes 13, 14 of a main plane 15.

The insert 10 with the splinters extends within an opening 38; and, in essence, sideways between end surfaces 21, 22 of the protective enclosure 2.

Due to the angled arrangement of the insert 10 within the warhead 1, there is formed an angle 23 between the main plane 15 and the longitudinal axis 24 of the airborne body 1. Through this angled position of the insert 10 within the airborne body 1 there is obtained a trapezoidally-shaped configuration of the insert 10 with a minimal length of the insert edge 26 measured along the transverse axis 17 of the warhead and a maximum length for the insert edge 27. As a result thereof, the insert 10 possesses a trapezoidal shape which continually widens in the direction of flight 30.

The function of the warhead 1 is essentially as follows:

An airborne body which is equipped with the warhead 1 is to be oriented through the intermediary of a known arrangement in the position extending within the direction of action of the insert 10 relative to its main direction 31 against a laterally offset positioned target through a so-called rolling of the airborne body. Also associated therewith is a known measure; namely, compensating for the change in the angle of splinter launching or discharge caused by the speed of the airborne body, in that the triggering angle; in essence, the angle which exits between the target and the trajectory, and at which the detonation is initiated, is varied with the speed of the airborne body.

When the booster charge 7 is triggered through of the safe-and-arm and triggering arrangement 6, then as a result of the detonation of the explosive 9, the fragments 20 are set into motion by means of the cover plate 11 in generally the direction 31 of the primary effect. Hereby, the protective enclosure 3 is similarly fragmented into splinters.

In accordance with FIG. 1, in dependence upon a speed of the airborne body of approximately 1,000 m/sec., there is attained a splinter angle 35 or spread of 60° relative to the rear wall 4.

Figure 2:
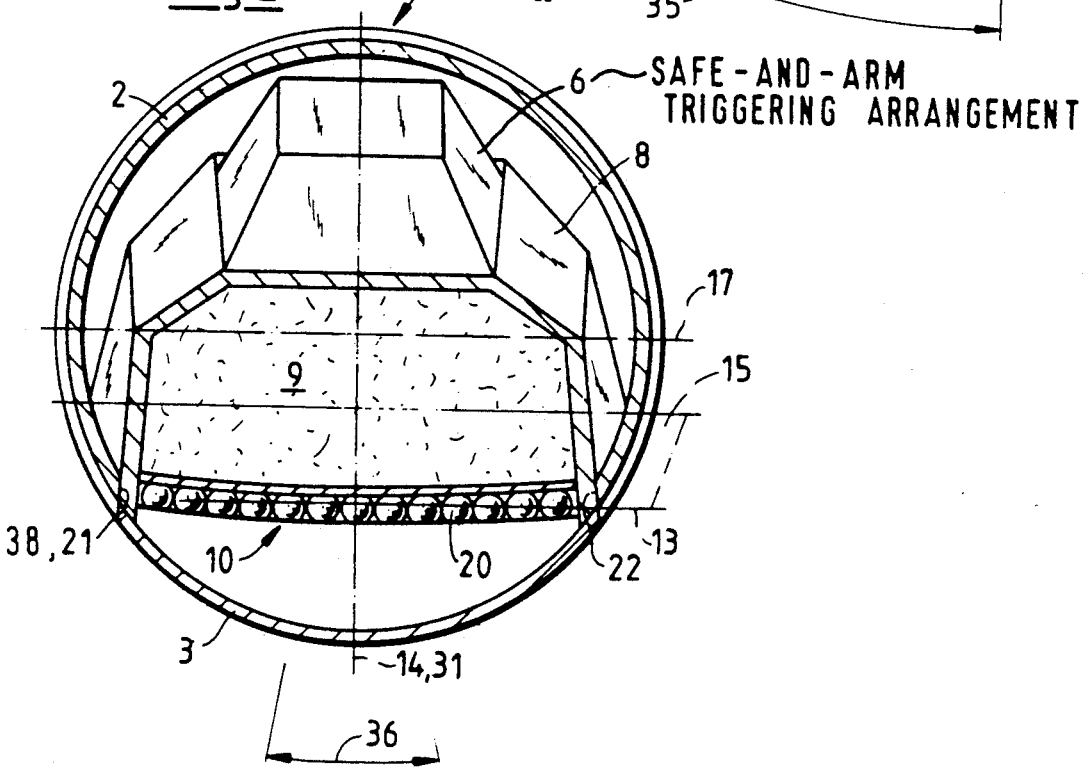
FIG. 2 illustrates a sectional view through the warhead taken along line II—II in FIG. 1.

Pursuant to FIG. 2, the angle of dispersion 36 for the splinters consists of about 22.5° along the orientation in the primary direction of action 31.

At an altitude of flight of approximately 20 meters, a ground surface of approximately 12 $m^2$ is covered with a relatively high splinter density.

In addition to the preformed splinters 20 it is also possible to provide a previously weakened fragment or splinter plate, or also an insert for the formation of a plurality of explosives-formed projectiles. Hereby, the splinters as well as the projectiles can also be provided with incendiary compositions.

What is claimed is:

1. A warhead for an airborne body for the attacking of a lightly-armored target through the intermediary of splinters, said warhead including a protective enclosure, a safe-and-arm and triggering arrangement, an explosive charge and splinter-producing insert being arranged within said enclosure, said splinter-producing insert being slightly convexly outwardly curved and located essentially within a single main plane, said main plane intersecting the longitudinal axis of the warhead at an angle of between about 5° to 30°, said insert, viewed in the direction of flight, having a bottom located below a transverse axis in the region of a rear wall of the warhead and continually rising in the direction of flight, and a triggering location for the explosive charge being in a longitudinal symmetrical axis of the charge proximate the rear wall of said warhead.

2. A warhead as claimed in claim 1, wherein the triggering location is generally located in the lower third of the length of the explosive charge.

3. A warhead as claimed in claim 1, wherein the triggering location is located at a distance from the rear wall which consists of approximately 1/5 the length of the explosive charge.

4. A warhead as claimed in claim 1, wherein the insert is slightly convexly curved in a direction transverse of the main plane thereof.

5. A warhead as claimed in claim 1, wherein the insert is slightly convexly curved in the longitudinal direction of the main plane thereof.

6. A warhead as claimed in claim 1, wherein a housing for the explosive charge bounds the sides of the insert through end surfaces of an opening formed in the protective enclosure.

7. A warhead as claimed in claim 1, wherein a section of the insert in the region of the bottom thereof lies in parallel with the transverse axis and the longitudinal axis of said warhead.

8. A warhead as claimed in claim 1, wherein the angle between the longitudinal axis and the insert is approximately 10°.

* * * * *